United States Patent [19]

Kekish et al.

[11] 4,354,872

[45] Oct. 19, 1982

[54] METAL OXIDE OIL SLURRIES

[75] Inventors: George T. Kekish, Chicago; Mei-Jan L. Lin, Naperville; John H. Collins, Bloomingdale, all of Ill.

[73] Assignee: Nalco Chemical Company, Oak Brook, Ill.

[21] Appl. No.: 226,302

[22] Filed: Jan. 19, 1981

Related U.S. Application Data

[63] Continuation-in-part of Ser. No. 101,938, Dec. 10, 1979, abandoned.

[51] Int. Cl.[3] ..... C04B 9/00; C04B 9/02; C04B 9/04; C23F 11/00

[52] U.S. Cl. ..... 106/14.27; 106/14.31; 106/14.33; 252/309; 252/389 R; 252/390; 252/391; 252/392; 252/394; 252/395; 252/396

[58] Field of Search ..... 106/14.27, 14.31, 14.33; 252/389 R, 390, 391, 392, 394, 395, 396, 309

[56] References Cited

U.S. PATENT DOCUMENTS

| | | | |
|---|---|---|---|
| 2,574,954 | 11/1951 | Bishop | 106/14.27 |
| 2,587,546 | 2/1952 | Matuszak | 106/14.27 |
| 2,892,724 | 6/1959 | Westlund et al. | 106/14.27 |
| 3,547,605 | 12/1970 | Cornelius et al. | 44/4 |

OTHER PUBLICATIONS

Kirk-Othmer, Encyclopedia of Chemical Technology, II, vol. I (1963), pp. 813-814 & 819-820.

Perry's Chemical Engineering Handbook, 5th Ed. (1973), pp. 9-9.

Rose, The Condensed Chemical Dictionary, 7th Ed., 1966, p. 31.

*Primary Examiner*—Howard E. Schain

*Attorney, Agent, or Firm*—John G. Premo; Robert A. Miller; John S. Roberts, Jr.

[57] ABSTRACT

A highly stable metal oxide oil slurry useful in reducing slag, facilitating removal of deposits from boiler tubes, and reducing corrosion on the heating surfaces of boilers has been developed. Such a slurry consists essentially of about 50% by weight magnesium oxide or the entity of magnesium oxide and alumina oxide, together with an oil-soluble emulsifier such as alkanolamide and preferably ethanolamide, or an alkanol with a carbon chain greater than a $C_3$ alcohol, an oil-soluble dispersant such as a $C_{12}$–$C_{22}$ entity selected from an unsaturated or saturated fatty acid; e.g., oleic acid. Also, as a constituent is an anionic surfactant such as magnesium lauryl sulfate in an oil base such as No. 2 fuel oil. The alkanolamide is fashioned from heating alkanolamines and fatty acids either in a 1:1 ratio or 2:1 ratio. The reactant amino alcohol is in the range $C_{10}$–$C_{24}$. The alcohol itself is greater than $C_3$ and up to $C_{16}$, with a preferred range $C_{12}$–$C_{16}$.

6 Claims, No Drawings

METAL OXIDE OIL SLURRIES

This is a continuation-in-part application of pending Ser. No. 101,938 filed Dec. 10, 1979, now abandoned.

This invention is a highly stable metal oxide oil slurry useful in reducing slag, facilitating removal of deposits from boiler tubes, and reducing corrosion on the heating surfaces of boilers. Such a slurry consists essentially of about 50% by weight magnesium oxide or the entity of magnesium oxide and alumina oxide, together with an oil-soluble emulsifier such as an alkanolamide or an alkanol with a carbon chain greater than a $C_3$ alcohol, an oil-soluble dispersant such as a $C_{12}$–$C_{22}$ entity selected from an unsaturated or saturated fatty acid such as oleic acid. Also, as a necessary constituent is an anionic surfactant such as magnesium lauryl sulfate in an oil base such as No. 2 fuel oil. The alkanolamide is fashioned from heating alkanolamines and fatty acids either in a 1:1 ratio or 2:1 ratio. The reactant amino alcohol is in the range $C_{10}$–$C_{24}$. The alcohol itself is greater than $C_3$ and up to $C_{16}$, with a preferred range $C_{12}$–$C_{16}$. The acid which is reacted to produce the alkanolamide is selected from a $C_{12}$–$C_{22}$ entity such as oleic acid, etc. The alcohol defined as greater than $C_3$ and which reacts with the amine to produce the alcohol amine may be greater than $C_3$ and up to $C_{16}$ and it is noted that the optimum detergent range is $C_{12}$–$C_{16}$.

Specialty oil slurries have been successfully developed for the application of reducing slagging, facilitating removal of slag and deposit from the fireside of the boiler tubes and reducing corrosion on the heating surfaces of the boilers. A generalized recipe of a typical composition is set out below.

| | Narrow | Broad |
|---|---|---|
| Metal oxide | 50% by wt. | 45–55% |
| Alkanolamide; e.g., ethanolamide | 1% by wt. | 1–3% |
| Oleic acid | 4% by wt. | 2–6% |
| Oil insoluble thickening and stabilizing agents (anionic surfactants); e.g., salts of alkyl sulfate, magnesium lauryl sulfate | 2% by wt. | 1–3% |
| No. 2 fuel oil | 43% by wt. | Balance |

A preferred oil is heavy aromatic naphtha.

Also, a recipe of more particular components is set out below:

| | |
|---|---|
| 45–55% | by weight of magnesium oxide or the entity of magnesium oxide and alumina oxide |
| 1–3% | by weight of alkanolamide |
| 2–6% | by weight of oleic acid |
| 1–3% | by weight of magnesium lauryl sulfate |
| | Balance hydrocarbon oil |

INDIVIDUAL COMPONENTS

The emulsifier and wetting agent are preferably nonionic surfactants; for example, alkanolamides or alcohols of chain links greater than $C_3$. The oil-soluble dispersant and stabilizer are preferably unsaturated and saturated fatty acids of chain link $C_{12}$–$C_{22}$; for example, oleic acid. The oil-insoluble thickening and stabilizing agents are anionic surfactants preferably salts of alkyl sulfates and alkyl aryl sulfonates; for example, magnesium lauryl sulfate.

TEMPERATURE AND TIME

The slurry is stable at ambient temperature and at 135° F. for an extended period of time (greater than three months). It is believed that the slurry as formed is stabilized through the formation and interaction of hydrophilic cores with lypophilic tails of the micelles. For example, a stable slurry was obtained by mixing 1 part alkanolamide with 4 parts oleic acid, 43 parts No. 2 fuel oil, 45.45 parts magnesium oxide, 4.55 parts alumina trihydrate, and 2 parts magnesium lauryl sulfate. The slurries are sterically stabilized by this new technique involving the formation of micelles and micelle-like network structures. A uniqueness was found in its good stability at moderate temperatures as shown above and also a smoother manufacturing process and good pourability.

THE EMULSIFIERS AND METAL OXIDES

With reference to the emulsifiers, a preferred alkanolamide is Witcamide 5138 (Witco Chemical Company). In the area of the metal oxide a preferred embodiment of alumina trihydrate is Alcoa C-330.

While it is noted that the particle size of the MgO material is predominantly in the 4–6 micron range, processing this material according to steps disclosed later in this specification produces a material having a particle size in the less than 2 micron size range.

It is to be noted that the above-described magnesium oxide slurry is only a preferred embodiment of this invention and other magnesium oxides containing from 20–70% and preferably 30–60% by weight magnesium oxide-hydroxide can be employed. The particle size distribution of the magnesium hydroxide slurry which is employed in the instant invention can range from 50 down to less than 2 microns. Preferably, the material should be a particle size in the range of about 30–2 microns. The magnesium hydroxide slurry thus described is further processed into the unique material of this invention.

THE HYDROCARBON OIL

The hydrocarbon oil utilized in this invention and which permits utilization of the parameter heavy oil and high aromatic oil is justified by reference to the ASTM detailed requirements for fuel oil. It is noted that in the gradation which appears in Perry's Chemical Engineers Handbook, 5th edition, 1973, page 9-9 (reproduced below) No. 5 and 6 are heavy oils so that the terms "high" and "heavy" have definite meaning in the oil industry.

TABLE 1

A.S.T.M. Detailed Requirements for Fuel Oils*

| Fuel oil grade | Description and requirements for use | Flash point, °F. (°C.) Min. | Pour point °F (°C.) Max. | Water and sediment, vol. % Max. | Carbon residue on 10% bottoms, % Max. | Ash, Wt. % Max. | Distillation Temperature, °F. (°C.) 10% Point Max. | 90% Point Min. | 90% Point Max. |
|---|---|---|---|---|---|---|---|---|---|
| No. 1 | A distillate oil intended for vaporizing pot-type burners and other burners requiring this grade of fuel | 100 or legal (38) | 0 | Trace | 0.15 | — | 420 (215) | — | 550 (288) |
| No. 2 | A distillate oil for general-purpose domestic heating for use in burners not requiring No. 1 fuel oil | 100 or legal (38) | 20 (−7) | 0.10 | 0.35 | — | — | 540 (282) | 640 (338) |
| No. 4 | Preheating not usually required for handling or burning | 130 or legal (55) | 20 (−7) | 0.50 | — | 0.10 | — | — | — |
| No. 5 (light) | Preheating may be required depending on climate and equipment | 130 or legal (55) | — | 1.00 | — | 0.10 | — | — | — |
| No. 5 (heavy) | Preheating may be required for burning and, in cold climates, may be required for handling | 130 or legal (55) | — | 1.00 | — | 0.10 | — | — | — |
| No. 6 | Preheating required for burning and handling | 150 | — | 2.0 | — | — | — | — | — |

*A.S.T.M. Burner Fuel Specification D 396 [from Perry's Chemical Engineers Handbook, 5th ed., 1973, page 9-9]

EXAMPLE 1

A number of exemplary recipies were made up embodying this example:

| | | |
|---|---|---|
| (A) | No. 2 fuel oil | 45.8 wt. % |
| | Magnesium oxide (Martin Marietta Grade 469) | 50.0 wt. % |
| | NINOL 201* (ethanolamide oleic acid) | 2.2 wt. % |
| | Magnesium lauryl sulfate | 2.0 wt. % |
| (B) | NINOL 201* (ethanolamide oleic acid) | 2.2 wt. % |
| | Oleic acid | 4.5 wt. % |
| | Hydrocarbon oil | 41.8 wt. % |
| | Magnesium oxide (Martin Marietta Grade 469) | 45.45 wt % |
| | $Al_2O_3.3H_2O$ | 4.55 wt % |
| | Diethanolamine lauryl sulfate (Stepanol DEA) | 1.5 wt % |

*NINOL (Stepan Chemical Company, Northfield, Illinois).
Witcamide 5138 (Witco Chemical Company, New York, New York), may be substituted for the NINOL compounds above.

EXAMPLE 2

Standard Procedure of Making Slurries

| | Typical Composition Percent | | |
|---|---|---|---|
| | All Magnesium | 10:1 $\frac{MgO}{Al_2O_3.3H_2O}$ | 2:1 $\frac{MgO}{Al_2O_3.3H_2O}$ |
| Alkanolamide | 1.80 | 2.00 | 1.80 |
| Oleic acid | 6.00 | 5.50 | 4.50 |
| Oil (Exxon) | 39.70 | 40.30 | 41.30 |
| MgO | 50.00 | 45.45 | 33.33 |
| $Al_2O_3.3H_2O$ | — | 4.55 | 16.67 |
| Diethanolamine lauryl sulfate | 2.50 | 2.20 | 2.40 |

PROCEDURE:

Mix emulsifier and dispersant with oil until homogeniety is achieved, usually 10 minutes.

Charge MgO and $Al_2O_3.3H_2O$ to the mixture and mix for one-half hour.

Charge thickener and continue mixing for 15 minutes.

Store the slurry in a closed container.

COMBINATION OF EMULSIFIER WITH OLEIC ACID

Mix 2% emulsifier, 43% oil, with 5% oleic acid.

Charge MgO until viscosity reaches ~8,000 cps.

Observe stability at room temperature and at 135° F.

THICKENER

Mix 1 to 4% thickener to either single or dual surfactants-slurry.

Record the viscosity increases.

Observed stability at room temperature and at 135° F.

EXAMPLE 3a

| | |
|---|---|
| Lauric acid amide | 2.00 |
| Oleic acid | 6.00 |
| Oil (Exxon), high aromatic | 40.50 |
| MgO | 45.45 |
| $Al_2O_3.3H_2O$ | 4.55 |
| Diethanolamine lauryl sulfate | 1.50 |

EXAMPLE 3b

| High Alumina | |
|---|---|
| Coconut oil amide | 1.80 |
| Ammonium Alkyl sulfate | 1.50 |
| Alumina trihydrate (Alcoa, C-330) | 16.67 |
| Oleic acid | 5.50 |
| MgO | 33.33 |

-continued

| High Alumina | |
|---|---|
| Heavy naphtha oil | 41.20 |

EXAMPLE 4

| | | |
|---|---|---|
| Stearic acid alkanolamide | 15 g | 0.5 wt. % |
| Oleic acid | 165 g | 5.5 wt. % |
| Oil | 1260 g | 42.0 wt. % |
| MgO | 1365 g | 45.45 wt. % |
| $Al_2O_3.3H_2O$ | 135 g | 4.55 wt. % |
| Magnesium alkyl sulfate | 60 g | 2.0 wt. % |

We claim:

1. A metal oxide slurry consisting essentially of:
(a) about 50% by weight of magnesium oxide or the entity of magnesium oxide plus alumina
(b) about 1% by weight of an oil-soluble emulsifier and wetting agent
(c) about 4% by weight of an oil-soluble dispersant
(d) about 2% by weight of an insoluble thickening agent
(e) about 43% by weight, or a balance, of a hydrocarbon oil.

2. A metal oxide oil slurry consisting essentially of:
(a) about 50% by weight of magnesium oxide
(b) about 1% by weight of alkanolamide
(c) about 4% by weight of oleic acid
(d) about 2% by weight of magnesium lauryl sulfate
(e) about 43% by weight of hydrocarbon oil.

3. A metal oxide oil slurry consisting essentially of:
(a) 45–55% by weight of magnesium oxide or the entity of magnesium oxide and alumina oxide
(b) 1–3% by weight of alkanolamide
(c) 2–6% by weight of oleic acid
(d) 1–3% by weight of magnesium lauryl sulfate
(e) the balance hydrocarbon oil.

4. The slurry according to claim 2 wherein the alkanolamide is ethanolamide.

5. The oil slurry according to claim 3 wherein the percentile of magnesium oxide is 45% by weight and the percentile of alumina is 5% by weight.

6. A metal oxide oil slurry consisting essentially of 1 part alkanolamide mixed with 4 parts oleic acid; 43 parts No. 2 fuel oil; 45.45 parts magnesium oxide; 4.55 parts alumina trihydrate; 2 parts maleic lauryl sulfate.

* * * * *